United States Patent [19]

Zambolin et al.

[11] 3,938,644

[45] Feb. 17, 1976

[54] HORIZONTAL TABULATION APPARATUS FOR ACCOUNTING MACHINES OR THE LIKE

[75] Inventors: Adriano Zambolin, Ivrea (Turin); Gianfranco Defalco, Samone (Turin), both of Italy

[73] Assignee: Ing. C. Olivetti & C., S.p.A., Ivrea (Turin), Italy

[22] Filed: June 5, 1974

[21] Appl. No.: 476,434

[30] Foreign Application Priority Data

June 12, 1973 Italy ..... 25091/73

[52] U.S. Cl. ..... 197/176; 197/179

[51] Int. Cl.[2] ..... B41J 21/04

[58] Field of Search ..... 197/176, 177, 178, 179

[56] References Cited

UNITED STATES PATENTS

| | | | |
|---|---|---|---|
| 1,132,558 | 3/1915 | Carlin | 197/176 |
| 2,841,266 | 7/1958 | Dicke | 197/177 |
| 3,646,268 | 2/1972 | Ricciardi et al. | 197/176 X |

FOREIGN PATENTS OR APPLICATIONS

| | | | |
|---|---|---|---|
| 1,901,716 | 1/1969 | Germany | 197/176 |

*Primary Examiner*—Edgar S. Burr
*Assistant Examiner*—R. E. Suter
*Attorney, Agent, or Firm*—Schuyler, Birch, Swindler, McKie & Beckett

[57] ABSTRACT

An horizontal tabulation apparatus wherein a plurality of sensing elements defines code combinations corresponding to the tabulation positions and divides a plurality of cams in groups each associated with predetermined tabulation positions; stopping means are actuated by the plurality of sensing elements when the groups generate the same code combination in correspondence with tabulation positions associated therewith.

10 Claims, 9 Drawing Figures

HORIZONTAL TABULATION APPARATUS FOR ACCOUNTING MACHINES OR THE LIKE

BACKGROUND OF THE INVENTION

In the first type of known tabulation systems, the various positions of arrest of the carriage are defined by a series of stop pins or studs located on the usual tabulator bar and settable selectively by the operator to define the positions of arrest.

In these systems, the travel of the carriage is controlled by the stop at which the carriage has halted, the said stop selecting a group of stops for the following stopping of the carriage. The tabulation effected in this way is excessively rigid and complicated, owing to the fact that after the first stop of the carriage it is no longer possible to alter the following stops.

In a second type of tabulation system, there is prearranged a first store comprising cams which indicates from time to time the actual position of the carriage according to the combination of teeth and hollows of the cams themselves, and a second store which can be set by programme is constituted by a series of mechanical elements having two positions, the combination of which represents the tabulation position to be reached. For effecting comparison of the contents of the said two stores there is prearranged a first series of sensing elements which sense the said cams and the said two-position elements simultaneously in order to control command means to shift the carriage when the contents of the two stores are not equal. A second series of sensing elements is moreover provided for arresting the carriage which are controlled by the first series of sensing elements when the first store indicates a position of the carriage equal to that of the second store.

This tabulation system has two fundamental disadvantages: the first consists of the fact that it is very complex in construction inasmuch as it comprises two stores and two series of sensing elements, one for controlling the travel of the carriage and the other for controlling the stopping thereof.

The second disadvantage, which is directly consequent, is that all the aforesaid mechanisms move sequentially, as a result of which the duration of a tabulation cycle is extremely long.

SUMMARY OF THE INVENTION

The tabulation apparatus, according to the invention, solves the technical problem of obtaining a high operating speed and considerable structural simplification, employing some groups of cams selected by a plurality of sensing elements, and which generate the same code combination in correspondence with the tabulation positions associated therewith to enable that plurality of sensing elements to actuate stop means.

DESCRIPTION OF THE PREFERRED EMBODIMENT

Figure 4:
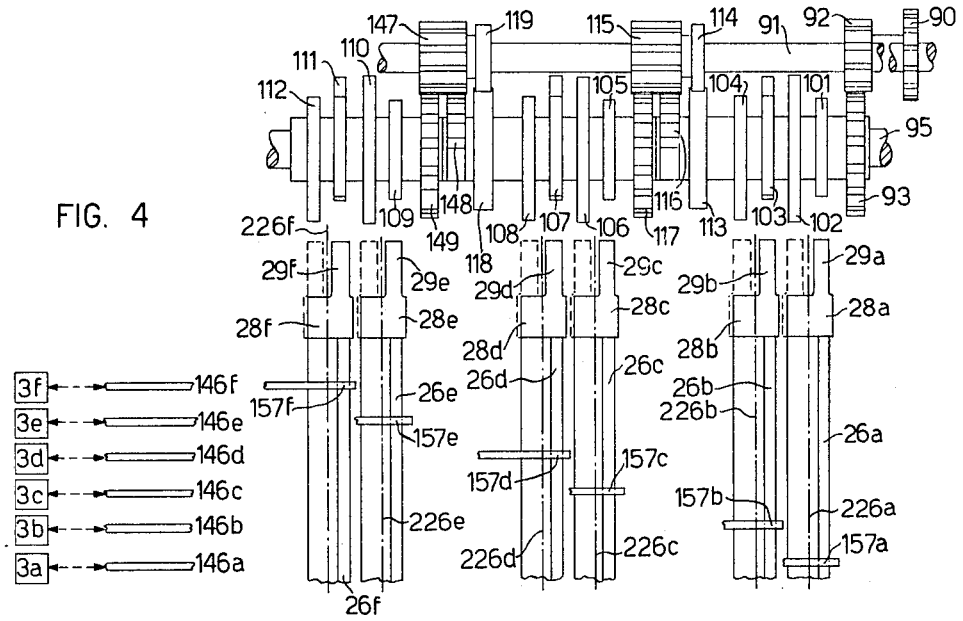
FIG. 4 is a plan view of a group of cams and sensing elements of the system of FIG. 2.

The horizontal tabulation apparatus T (FIG. 2), according to the invention, is incorporated by way of example in an accounting machine 2, (FIG. 1) comprising a frame 1, a typing head 201, for example of the type described in Italian Patent No. 889,230 in the name of the Applicants, and a support for the paper constituted by a platen 202 disposed transversely on the machine and adapted to be rotated in a known manner drawings, to command the line spacing of the paper.

The typing head 201 is supported by a carriage 203 adapted to be shifted selectively in the transverse direction to change its position with respect to the support 202 for the paper. The carriage 203 is guided by two transverse bars 204 and 205 fixed to the sides of the machine. The carriage 203 moves parallel to the support 202, with respect to which it can adopt in this particular case one hundred and twenty-eight different positions.

Figure 1:
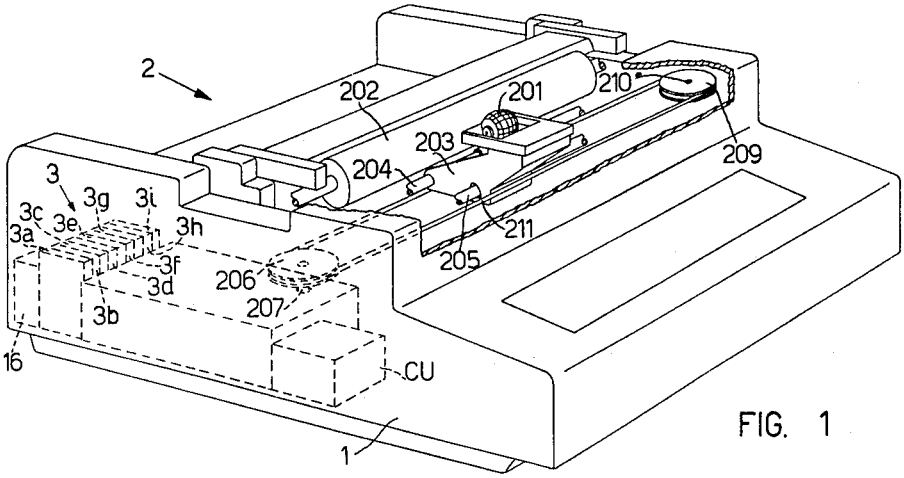
FIG. 1 is a partially open perspective view of an accounting machine comprising the tabulation system according to the invention.

The movement of the carriage 203 is controlled by an electronic device 16 adapted to supply in a known manner signals coded in a code combination composed of nine bits. More particularly, the device 16 can be controlled by a control unit CU, which sends to it the information relating to the position to be reached through the tabulation. The exchange of data between the control unit CU and the device 16 is not described in detail since it is outside the objects of the present invention. A suitable systen for the electronic device 16 and for the control unit CU is described in the British Pat. No. 1,239,753. The nine bits supplied by the device 16 assume more particularly the following significance: the first six bits represent the position which the carriage 203 is to reach, the seventh bit represents the direction of tabulation, the eighth the rectification of the position of the typing head 201, while the ninth controls the starting of the mechanical tabulation cycle. The wires on which the nine bits are present are electrically connected to a group 3 of nine electromagnets 3*a*, 3*b*, . . . 3*i* (FIG. 1). The first six electromagnets 3*a*, 3*b*, . . . 3*f* are individually connected, to the same number of sliders 146*a*, 146*b* to 146*f* (FIG. 4), respectively. Each of the sliders 146*a* to 146*f* can translate, adopting one or the other of two positions according to whether the corresponding electromagnet 3*a* to 3*f* is activated or not. Each of the sliders 146*a* to 146*f* is connected through the medium of fork 157*a* to 157*f* to a corresponding rib 26*a* to 26*f* of the same number of sensing elements 28*a* to 28*f*, which can turn about their longitudinal axis 226*a* to 226*f* to adopt one or the other of two positions indicated by solid lines and dash lines, respectively, in FIG. 4. Thus, for example, the bits at zero level which control the six electromagnets 3*a* to 3*f* can rotate the corresponding sensing elements 28*a* to 28*f* clockwise and the corresponding projections 29*a* to 29*f* are moved to the right (solid lines). On the other hand, as regards the bits at one level corresponding to the electromagnets 3*a* to 3*f*, these cause the projections 29*a* to 29*f* to rotate to the left (position indicated in dash lines).

Figures 2, 3:
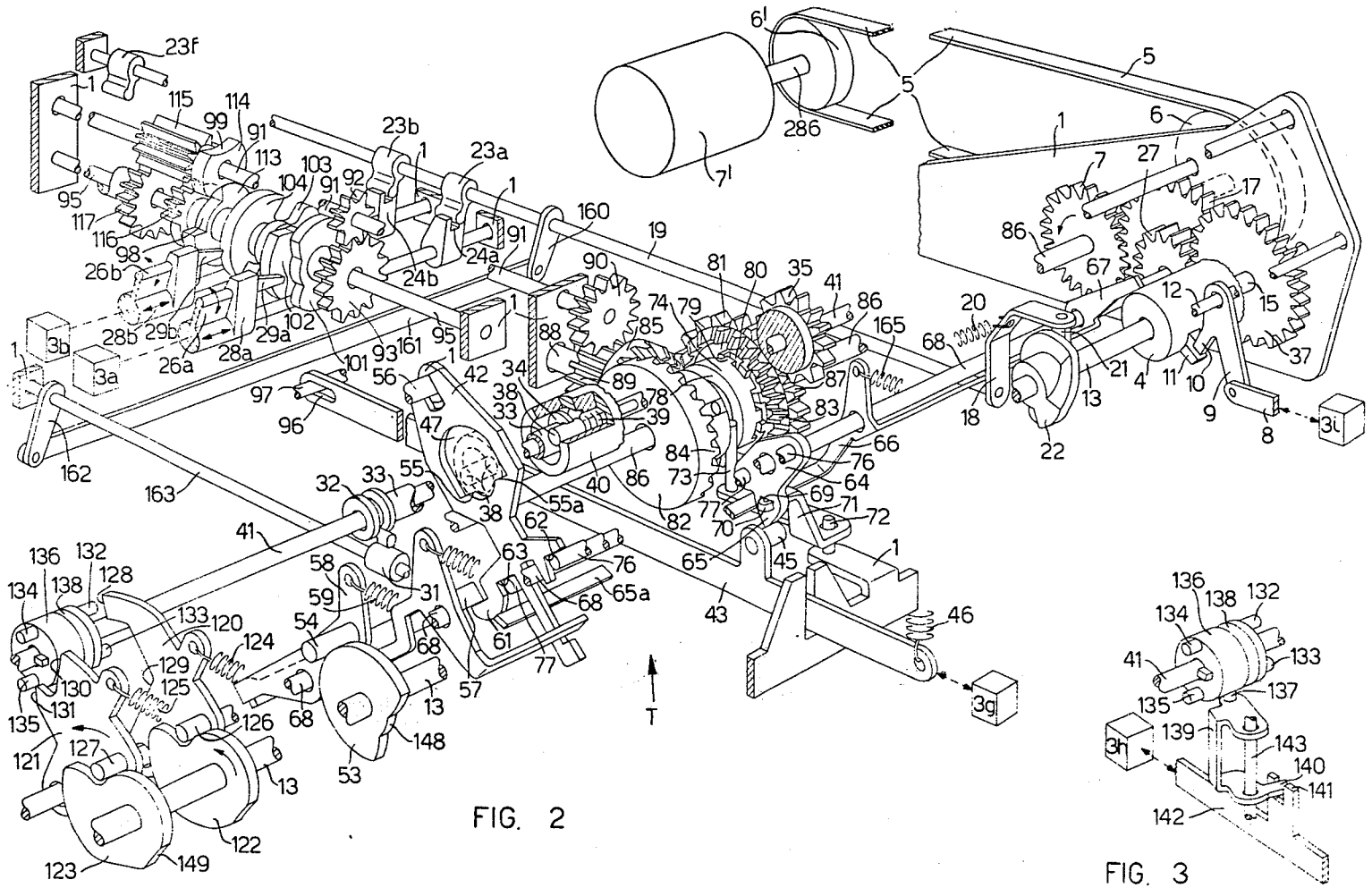
FIG. 2 is a partial perspective view of the system according to the invention.
FIG. 3 is perspective view of a detail of the tabulation system of FIG. 2.

Referring to FIG. 2, the coupling between the electromagnets 3 and the sensing elements 28*a* to 28*f* is represented by a dash line.

The sensing elements 28*a* to 28*f* co-operate with a series of twelve cams 101, 102 to 112 (FIGS. 2 and 4) which are subdivided into three like groups of four cams each, which are rotatable on a fixed shaft 95. The corresponding cams of each group are alike in order and oriented alike as between them; thus, the first cam 101 of the first group is like the cams 105 and 109 of the second and third groups; the second cam 102 of the first group is like the cams 106 and 110, and so on. The profile of the cam 101 (FIG. 5) is formed by an alternate succession of spaces and teeth each extending over an arc of 90°. The cam 102 (FIG. 6) has a profile identical to that of the cam 101, but is offset through 90° with respect thereto. The profile of the cam 103 (FIG. 7) is formed by one tooth and one space each extending over an arc of 180°. The cam 104 (FIG. 8) is identical to the cam 103, but is offset through 180° with respect thereto. The relative position of the four cams 101, 1-2, 103, 104 is as indicated in FIGS. 5 to 8.

A gear wheel 92 (FIGS. 2 and 4) is fast with a shaft 91 rotatable with respect to the frame 1 of the machine and meshes with a corresponding gear wheel 93 fast with the first group of cams 101, 102, 103 and 104. A toothed sector 116, the teeth of which extend over an arc of 90°, is also fixed to the said first group of cams 101, 102, 103, 104 and is adapted to mesh with a toothed drum 115 which can rotate freely on the shaft 91.

The toothed drum 115 meshes in turn with a gear wheel 117 fast with the second group of cams 105 to 108.

In the same way, the second group of cams 105, 106, 107, 108 is fast with a second toothed sector 148 similar to the sector 116 and meshing with a second toothed drum 147 rotatable idly on the shaft 91. The toothed drum 147 meshes in turn with a gear wheel 149 fast with the third group of cams 109 to 112.

In this way, to each revolution of the first group of cams 101 to 104 there corresponds a rotation of the second group of cams 105 to 108 for a quarter of a revolution. Similarly, to a rotation of one revolution of the second group of cams 105 to 108 there corresponds a rotation of the third group of cams 109 to 112 for a quarter of a revolution. Consequently, to sixteen revolutions of the first group of cams 101 to 104 there correspond four revolutions of the second group of cams 105 and 108 and a single revolution of the third group of cams 109 to 112.

To lock the second group of cams 105 to 108 during the rotation for the first 270° in each revolution of the first group of cams 101 to 104, during which 270° the sector 116 does not mesh with the drum 115, there is keyed on the shaft 95, fast with the cams 101 to 104, a circular disc 113 (FIGS. 2 and 4) having a space or recess 98 which extends over an arc of 90° in correspondence with the teeth of the sector 116.

The disc 113 co-operates, for a rotation of 270° corresponding to the space of time during which the sector 116 does not mesh with the drum 115, with a complementary circular profile 99 of a two-lobed cam 114 fast with the drum 115.

When the toothed sector 116 begins to mesh with the drum 115, the cam 114 rotates therewith, engaging the recess 98 of the disc 113 with one of its lobes, allowing the drum 115 in this way to cause the second group of cams 105 to 108 to rotate.

When the sector 116 has completed its rotation of 90°, the recess 98 of the disc 113 releases the lobe of the cam 114 and the circular profile of the disc 113 returns to engage the corresponding profile 99 of the cam 114, stopping in this waay any further rotation of the second group of cams 105 to 108. Similarly, a locking device 118, 119 completely similar to that just described is provided between the second and third groups of cams, 105 to 108 and 109 to 112 respectively.

The manner in which the decoding of each tabulation position is effected will now be described.

First of all, it is necessary to say that the sensing elements 28*a* to 28*f* can moreover translate at the same time along their own longitudinal axis in a manner which will be described hereinafter and that the shaft 91 rotates, as will be seen hereinafter, in synchronism with the movement of the carriage 203.

For simplicity, reference will be made only to the first group of cams 101 to 104 and to the corresponding sensing elements 28*a* and 28*b*. If the sensing elements 28*a* and 28*b* are both translated to the right (solid lines in FIG. 4), they can co-operate with the cams 101 and 103. As can be observed from FIGS. 5 and 7, the two cams 101 and 103 both have a space in correspondence with the projections 29*a* and 29*b* of the sensing elements 28*a* and 28*b*. In this way, the sensing elements 28*a*, 28*b* can advance simultaneously, as will be described hereinafter, until they touch the respective cams 101 and 103. This, as will be seen hereinafter, will cause the arrest of the carriage 203 in the position corresponding to that adopted by the cams 101, 103 and represented in FIGS. 5 and 7.

If, on the other hand, the two sensing elements 28*a* and 28*b* are shifted to the left (dash lines), they can co-operate with the cams 102 and 104, which both present a tooth to the projections 29*a* and 29*b*, as a result of which the two sensing elements 28*a*, 28*b* cannot advance. After a rotation of 90° with respect to the position indicated in FIGS. 6 and 8, the cams 102, 104 both present a space, as a result of which the two sensing elements 28*a*, 28*b* can advance at the same time until they touch the spaces themselves and again arrest the carriage 203.

Figure 5:
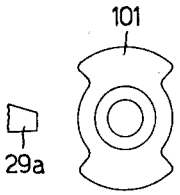
FIGS. 5 to 8 are side views of the cams of FIG. 4.
Figure 8:
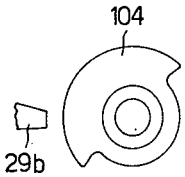

If, moreover, the sensing element 28*a* is moved to the right and the sensing element 28*b* to the left, they will be able to advance simultaneously until they touch the spaces of the corresponding cams 101 and 104 only after a rotation of 180° with respect to the position indicated in FIGS. 5 and 8.

Figure 6:
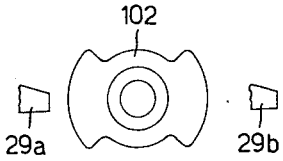
Figure 7:
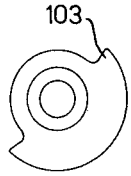

If, finally, the sensing element 28*a* is moved to the left and the sensing element 28*b* is moved to the right, they will be able to advance simultaneously only after a rotation of the cams 102 and 103 through 270° with respect to the position indicated in FIGS. 6 and 7.

It has therefore been seen how, in a complete rotation of the first group of cams 101 to 104, there can be decoded four different tabulation positions in accordance with the level (1 or 0) of the bits associated with the electromagnets 3*a* and 3*b* which control the sensing elements 28*a* and 28*b*, respectively.

In the same way, the sensing elements 28*c* and 28*d* co-operate with the second group of cams 105 to 108 and the sensing elements 28*e* and 28*f* co-operate with the third group of cams 109 to 112.

Since it has been stated that to each complete revolution of the third group of cams 109 to 112 there correspond four revolutions of the second group of cams 105 to 108 and sixteen revolutions of the first group of cams 101 to 104, with each position decoded in the manner described by the third group of cams 109 to 112 there can be associated four positions decoded by the second group of cams 105 to 108, with each of which there can also be associated four positions decoded by the first group of cams 101 to 104.

To sum up, the six electromagnets 3*a* to 3*f* and the three groups of cams 101 to 104; 105 to 108; 109 to 112 can decode a total of 64 different tabulation positions.

Of course, by adding a fourth group of cams connected to the third in the same way as that in which the first two groups of cams are connected, and a fourth pair of sensing elements, 128 tabulation positions can be decoded. More generally speaking, by employing $n$ groups of cams and $n$ pairs of sensing elements, $2^n$ tabulation positions can be decoded.

In this way there has been described the kinematic chain which begins at the electromagnets 3*a* to 3*f* and ends with the cams 101 to 112.

The other three electromagnets 3*g*, 3*h*, 3*i* (FIG. 1) are connected in known manner represented in FIGS. 2 and 3 by a broken line to sliders 43, 142 and 8, respectively.

The slider 8 is connected to the lever 9 which can turn anticlockwise about a pin 12 fixed to the frame 1 so as to remove the projection 10 from the path of the dog 11 belonging to a coupling of known type indicated generally by the reference 4 and fast with the driven shaft 13 rotatable in the frame 1. The coupling 4 is adapted to engage the shaft 13 with a driving shaft 15 rotatable in the frame 1 when the dog 11 is not cooperating with the projection 10.

Keyed on the shaft 15 is a gear 37 meshing with another gear 27 rotatable on a shaft 68 fixed to the frame 1. On the shaft 68 there also rotates, being fast with the gear 27, a second gear 17 meshing with a gear 7 fast with a shaft 86. The shaft 86, which is rotatable in the frame 1, is kept in continuous rotation by a motor 7' through the medium of a pulley 6 fixed to the shaft 86, a belt 5, and a pulley 6; fast with a shaft 28*b* of the motor 7'.

The gears 7 and 17 have the same pitch diameter, so that the transmission ratio between the shafts 86 and 68, in the example described, is 1 : 1, while the gears 27 and 37 have diameters which are in the ratio of 1 : 3 to one another. Consequently, the shaft 15 performs one revolution for every three revolutions of the shaft 68.

Thus, for example, if the shaft 86 rotates anticlockwise at a speed of rotation of 960 r.p.m., the shaft 15 rotates anticlockwise at a speed of rotation of 320 r.p.m., corresponding to a period of 187.5 msec.

A rocking lever 58 can turn on the shaft 68 through the action of a spring 59, the other end of which is fixed to the frame 1. The rocking lever 58 bears through the medium of a pin 54 on a cam 53 fast with the shaft 13. An extension 57 of the rocking lever 58 intercepts a first lug 61 of a slider 42 slidable on the shaft 68 and on a pin 56 fixed to the frame 1. In the slider 42 there is formed an opening 47 the upper part of which is shaped in a circular arc and the lower part of which has two plane shoulders 55 and 55a, respectively.

On the shaft 68 there can moreover oscillate a rocking lever 64 provided with a substantially wedge-shaped projection 65. Formed in the rocking lever 64 in the proximity of the projection 65 is a slot 69 in which is engaged one end 70 of a bell-crank lever 71 pivoted on a pin 72 fixed to the frame 1.

To the rocking lever 64 there are fixed two pins 76 and 77 disposed parallel to, and spaced symmetrically from, the shaft 68 and which co-operate with two abutment surfaces 62 and 63 formed in the lower part of the slider 42.

The slider 43 is slidable on a pin 97 fixed to the frame 1 by means of a slot 96 and is drawn upwardly at the other end by a spring 46 fixed to the frame 1. The slider 43 moves a pin 45 adapted to bear against one or the other of the two sides of the projection 65 through the action of the spring 46.

The slider 43 can be moved to the left or to the right (FIG. 2) according to whether the bit relating to the direction of tabulation assumes zero value or one value, respectively, since, as has been said, it is actuated by the electromagnet 3*g* appertaining to the direction of tabulation.

A pin 73 fast with the bell-crank lever 71 is adapted to engage a groove 78 formed in a sleeve 74 angularly fast with the shaft 86, but slidable axially thereon. The sleeve 74 carries at each end a ring of axial teeth, only the right-hand ring of axial teeth 79 being shown in FIG. 2 for simplicity of the drawing.

When the sleeve 74 is moved to the right, the teeth 79 mesh with a corresponding ring gear 80 formed on a sleeve 81 which can rotate freely on the shaft 86. On the other hand, when the sleeve 74 is moved to the left it can engage, in a similar manner not shown for simplicity of the drawing, with a sleeve 82 rotatable freely on the shaft 86. The sleeves 81 and 82 are provided with bevel teeth 83 and 84, respectively, meshing with a bevel pinion 85 fixed on a shaft 88 rotatable in the frame 1 of the machine.

Formed integrally with the pinion 85 is a gear wheel 89 meshing with a gear wheel 90 fixed on a shaft 91 rotatable in the frame 1 of the machine. The shaft 91 is adapted to transmit the movement to a gear 92 meshing with a gear 93 rotatable on a shaft 95 fixed to the frame 1. As has been said, the gear 93 is fast with the first group of cams 101 to 104. 93 is fast with the first group of cams 101 to 104.

The kinematic chain which has just been described, constituted substantially by the electromagnet 3*g*, the slider 43, the rocking lever 64, the bell-crank lever 71, the bidirectional clutch 78, 81-84-85 and the first group of cams 101 to 104, therefore enables the cams 101 to 112 themselves to be rotated in one direction or the other in dependence upon the activation or absence of activation of the electromagnet 3*g*. From this kinematic chain there is also derived the movement of the carriage 203. In fact, the carriage 203 is connected, in a manner which will be described hereinafter, to a shaft 41 which is driven by a gear 35 driven in turn by a ring gear 87 fast with the sleeve 81.

Consequently, when the electromagnet 3*g* is activated, the slider 43, acting through the kinematic chain described, shifts the sleeve 74 to the right as a result of which the sleeve 81 rotates anticlockwise and the shaft 41 rotates clockwise, so that the carriage 203 is shifted, for example, to the right; at the same time, the cams 101 to 112 rotate clockwise in the manner described.

When, on the other hand, the sleeve 74 is shifted to the left, the sleeve 84 rotates anticlockwise and the pinion 85 rotates anticlockwise and causes the sleeve 81 to rotate clockwise, as a result of which the carriage 203 moves to the left and at the same time the cams 101 to 112 rotate anticlockwise.

The mechanism adapted to arrest the carriage 203 when it has reached the tabulated position will now be described. This mechanism comprises a crank element 18 which, fixed on a shaft 19, is held by a spring 20 so that it bears by means of a pin 21 against a face cam 22 fast with the shaft 13. A group of tabs or lugs 23*a*, 23*b*, 23*f* fast with the shaft 19 individually engage corresponding forks 24*a* 24*b* fast with the sensing elements 28*a* 28*b*. The lugs 23*c*, 23*d*, 23*e* are not shown in the drawing, because they are similar to the lugs 23*a*, 23*b* and 23*f*; as well as the forks 24*c*, 24*d*, 24*e*, 24*f* are not shown in the drawing because they are similar to forks 24*a*, 24*b*. It is to be noted that the lugs 23*c*, 23*d*, 23*e* engage the corresponding forks 24*c*, 24*d*, 24*e* respectively, and that the forks 24*c*, 24*d*, 24*e* are fast with the sensing elements 28*c*, 28*d*, 28*e*. A crank 160 fast with the shaft 19 is connected to one end of a connecting rod 161 pivoted at the other end to a crank 162 fixed to a shaft 163 rotatable in the frame 1 of the machine. the shaft A crank 31 fast with the shaft 163 co-operates with a collar 32 of a sleeve 33 slidable axially on thes haft 41 rotatable in the frame 1 of the machine.

A guide disc 34 fast with the sleeve 33 engages pins 38 slidable axially in a barrel 40 fast with the shaft 41 and with the gear 35. The pins 38 are adapted to engage the opening 47 in the slider 42 under the thrust of individual springs 39.

As long as at least one of the ends 29*a* to 29*f* of the sensing elements 28*a* to 28*f* engages a tooth of the corresponding cam 101 to 112, the corresponding tab 23*a* to 23*f* cannot rotate completely anticlockwise, as a result of which the sleeve 33 is shifted to the left only for a small distance. Consequently, the pins 38 are only facing the opening 47 in the slider 42. When, on the other hand, all the ends 29*a* to 29*f* encounter a space at the same time on the corresponding cams 101 to 112, the tabs 23*a* to 23*f* rotate anticlockwise and the sleeve 33 is consequently shifted further to the left and, therefore, one of the pins 38 engages one or the other of the shoulders 55 and 55*a* according to the direction of rotation of the shaft 41, producing a downward movement of the slider 42, which, as will be seen hereinafter, causes the arrest of the shaft 41.

The rectifying device will now be described, this comprising a barrel 136 of substantially cylindrical form fixed angularly to the shaft 41 and slidable axially thereon. On the end faces of the said barrel 136 there are fixed two pairs of pins 132, 133 and 134, 135, respectively, which are diametrically opposed with respect to the axis of the shaft 41. Moreover, there is formed in the barrel 136 a groove 138 adapted to cooperate with a pin 137 (FIG. 3) of a bail 139 which can turn about a pin 143 fixed to the frame 1 of the machine. The said bail 139 is moreover provided with a lug 140 engaging a fork 141 integral with the slider 142.

In this way, if the value of the bit corresponding to rectification of the tabulated position is zero, the electromagnet 3*h* (FIG. 1) is not energized and the slider 142 is located in the rest position (FIG. 3). Consequently, the barrel 136 is shifted to the right (FIGS. 2 and 3) and in this position a rocking lever 120 which can turn on the shaft 68 is adapted to interfere by means of two abutment surfaces 128, 129 with the pins 132 and 133, respectively, through the action of a cam 122 fast with the shaft 13. The rocking lever 120 is held so that it bears against the cam 122 by means of a pin 126 through the action of a spring 124 fixed to the frame 1. When the cam 122 presents its solid portion in correspondence with the pin 126, the rocking lever 120 turns anticlockwise, as a result of which the abutment surface 128 engages the pin 132 of the barrel 136, causing the shaft 41 to turn anticlockwise. The rotation takes place until such time as the other pin 133 of the barrel 136 bears against the abutment surface 129, so that the rotation of the shaft 41 is limited to a well-defined value and the shaft 41 is thereafter locked in the position reached.

If, on the other hand, the bit corresponding to rectification of the tabulated position has the value one, the barrel 136 is shifted to the left. In this position, a rocking lever 121 which can turn on the shaft 68 is adapted to interfere by means of two abutment surfaces 130, 131 with the two pins 134 and 135, respectively, through the action of a cam 123 fast with the shaft 13. The rocking lever 121 is held so that it bears against the cam 123 by means of a pin 127 through the action of a spring 125 connected to the frame 1. When the cam 123 presents its solid portion in correspondence with the pin 127, the rocking lever 121 turns anticlockwise, as a result of which the abutment surface 131 engages the pin 135 of the barrel 136, causing the shaft 41 to rotate clockwise. The rotation takes place until such time as the other pin 134 of the barrel 136 bears against the abutment surface 130 of the rocking lever 121, so that the rotation of the shaft 41 is limited to a well-defined value equal to one rectifying step and the shaft 41 is thereafter locked in the position reached.

There will now be described the mechanism which is adapted to shift the carriage 203 along the platen 202, which comprises a first pulley 206 (FIG. 1) rotatable on a shaft 207, connected to the shaft 41 in a known manner and not shown in the drawing. The pulley 206 is connected by means of a belt 211 to a second pulley 209 rotatable about a shaft 210. The belt 211 is passed around each of the said pulleys 206 and 209 over an arc of 180° and has its ends fixed to the carriage 203, as a result of which on a rotation of the shaft 207 there is obtained a corresponding movement of the carriage 203.

Figure 9:
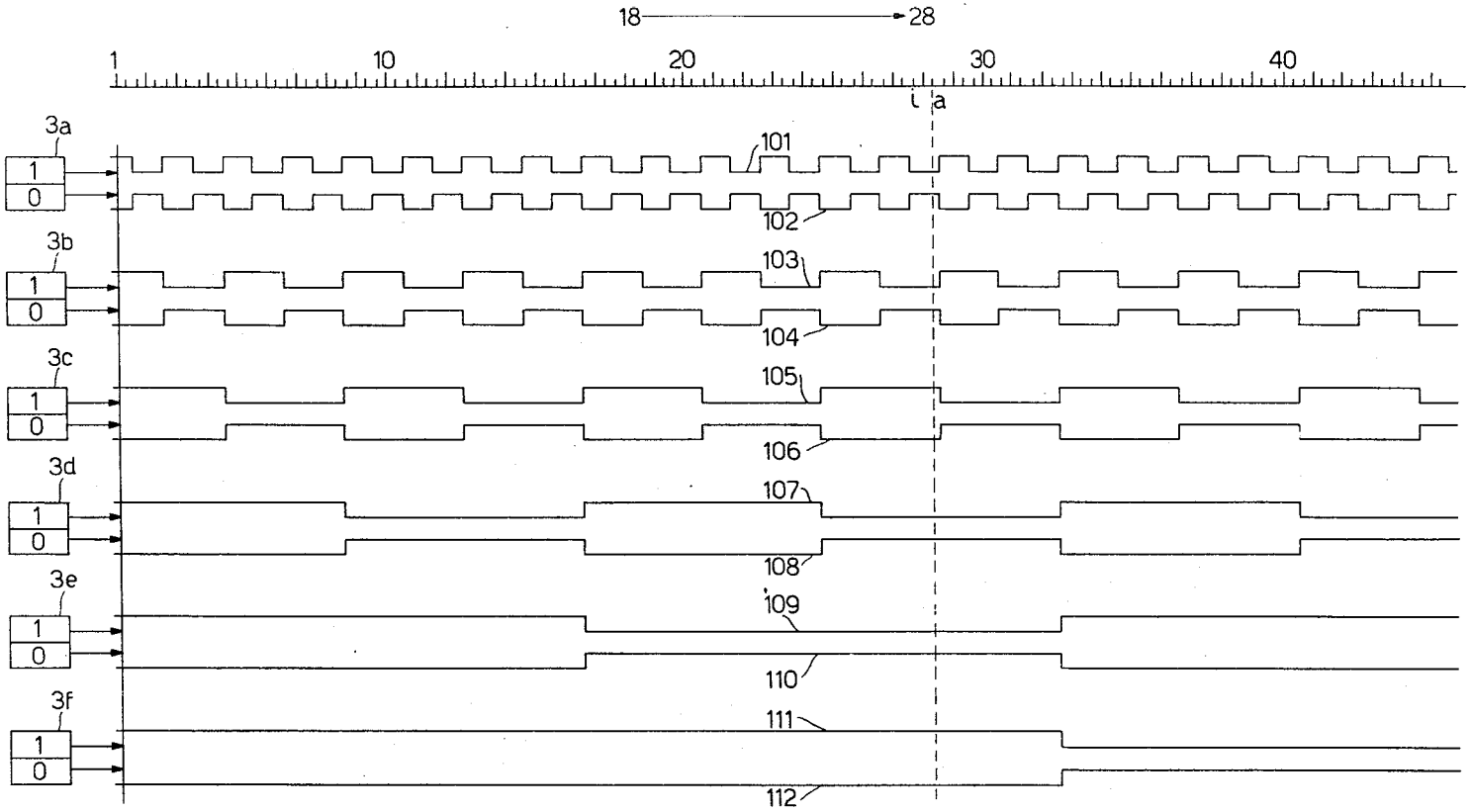
FIG. 9 is a diagram of the development of the profiles of the cams of FIG. 4.

A description of the operation of the tabulation system according to the invention will now be given. Reference will now be made to FIG. 9, which shows the development of the profiles of the cams 101 to 112. More particularly, in the first line at the top, there are represented for example by numbers 45 of the 64 possible tabulation positions reachable by means of the system according to the invention. For each tabulation position there is represented by the letter *a* the position reachable by means of a forward rectification and by the letter *i* the position reachable by means of a backward rectification.

The first profile diagram relates to the cam 101, the second to the cam 102, the third to the cam 103, and so on as far as the cam 112.

For each electromagnet 3*a* to 3*f*, indicated by a rectangle, the symbols 1 and 0 are to indicate that the corresponding sensing element 28*a* to 28*f* co-operates with one or the other of the profiles indicated by the arrows. For instance, the electromagnet 3*d* at level 1 signifies that the sensing element 28*d* co-operates with the cam 107.

Let it now be assumed that it is desired to reach the tabulation position indicated by a dash line and corresponding to the tabulation position 28 rectified forward starting, for example, from the tabulation position 18.

This position is represented by a combination of bits generated by the control unit 16 (FIG. 1), which energizes the electromagnets 3*a* to 3*i* as indicated by the following Table.

| 3a | 3b | 3c | 3d | 3e | 3f | 3g | 3h | 3i | |
|---|---|---|---|---|---|---|---|---|---|
| 1 | 1 | 0 | 1 | 1 | 0 | 1 | 1 | 1 | |
| | | | | | | | | | start of cycle |
| | | | | | | | | | forward rectification |
| | | | | | | | | | forward tabulation |
| | | | | | | | | | tabulation position |

In fact, so that the spaces of all the cams 101 to 112 concerned may be presented at the same time in front of the sensing elements 28*a* to 28*f*, the following conditions must occur:

the electromagnet 3*a* is energized (1 level), so that the sensing element 28*a* co-operates with the cam 101 the electromagnet 3*b* is energized (1 level), so that the sensing element 28*b* co-operates with the cam 103 the electromagnet 3*c* is deenergized, so that the sensing element 28*c* co-operates with the cam 106 the electromagnet 3*d* is energized, so that the sensing element 28*d* co-operates with the cam 107 the electromagnet 3*e* is energized, so that the sensing element 28*e* co-operates with the cam 109 the electromagnet 3*f* is deenergized, so that the sensing element 28*f* co-operates with the cam 112.

Moreover, the energized electromagnet 3*g* indicates that the carriage 203 must move to the right the energized electromagnet 3*h* indicates that the rectification is forward.

and the energized electromagnet 3*i* gives rise to the starting of the tabulation cycle.

In fact, the electromagnet 3*i* moves the projection 10 of the lever 9 which interferes with the dog 11 of the coupling 4. In this way, the driving shaft 15 sets the shaft 13 in rotation anticlockwise, so that the negative action cam 53 brings the space 148 in front of the pin 54, releasing the slider 42 and moving the extension 57 of the bail 58 away from the end 61 of this slider 42. At the same time, the face cam 22, which also has a negaative action, brings its descending face into correspondence with the pin 21 and therefore allows the sensing elements 28*a* to 28*f* to bring their corresponding ends 29*a* to 29*f* to bear against at least one tooth of the cams 101 to 112. Consequently, the sleeve 33 shifts partially to the left, so that the pins 38 of the barrel 40 cannot yet engage the shoulders 55 and 55*a* of the slider 42.

At the same time, as has been described, the energization of the electromagnet 3*g* causes the clockwise rotation of the rocking lever 64, which produces the movement of the pin 73 to the right. The pin 73 shifts the sleeve 74 to the right, as a result of which the shaft 86 sets the shaft 41 in clockwise rotation, so that the carriage 203 moves to the right and, through the bevel pinion 85, sets the first group of cams 101 to 104 in clockwise rotation. Moreover, through the medium of the pin 77, the rocking lever 64 raises the slider 42 which, as has been seen, is no longer held stationary by the end 57 of the bail 58. The rotation of the shaft 41 and the cams 101 to 104 causes, as has been seen, the rotation of the other cams 105 to 112, which continues until such time as they do not present all the spaces at the same time in front of the sensing elements 28*a* to 28*f*.

At this point the sensing elements 28*a* to 28*f* advance simultaneously owing to the effect of the spring 20, which causes the shaft 19 to turn anticlockwise. Consequently, the sleeve 33 is shifted further to the left, so that one of the pins 38 of the barrel 40, which is in rotation with the shaft 41 during the movement of the carriage 203, co-operates with the shoulder 55*a* of the slider 42, thereby lowering it.

The lowering of the slider 42 causes, through the medium of the pin 77, an anticlockwise rotation of the rocking lever 64, bringing it into a position such that the pin 73 brings the sleeve 74 back into the central position. At this point the shafts 41 and 91 are disengaged, as has been seen, from the driving shaft 86, so that the carriage 203 stops in the tabulated position. At this point the cam 22 has performed a rotation of approximately 180°, so that it presents its ascending face in front of the pin 21 and, in this way, moves the sensing elements 28*a* to 28*f* away from the cams 101 to 112 by means of the shaft 19 and at the same time releases the slider 42 from the pins 38 of the barrel 40.

The lowering of the slider 42 produces an anticlockwise rotation of a bail 66, which removes one of its ends 67 from the path of the dog 11, as a result of which the shaft 13 continues its rotation beyond 180°.

Thereafter, the electromagnet 3*h* having shifted the barrel 136 to the left, the cam 123 intervenes and, being also rotated through more than 180°, presents the beginning 149 of its active zone in front of the pin 127 of the rocking lever 121, which therefore rotates anticlockwise. Consequently, as has been said, the abutment surface 131 engages the pin 135, causing the barrel 136 and, therefore, the shaft 41 to rotate clockwise through a certain angle corresponding to the rectifying step of the carriage 203.

At this point, the cam 53, returning to its initial position, brings its full or solid portion back into correspondence with the pin 54, therefore locking the slider 42 through the rocking lever 58.

All this takes place if the reaching of the tabulated and unrectified position of the carriage 203 occurs within the 180° rotation of the shaft 13. If this does not happen, the shaft 13 and the coupling 4 have performed a 180° rotation before the slider 42 has been lowered by one of the pins 38. Consequently, a spring 165 can cause the bail 66 to turn clockwise, one end 65*a* of which bail co-operates with the end 61 of the slider 42. The clockwise rotation of the bail 66 brings its end 67 into the path of the dog 11, as a result of which the coupling 4 is disengaged, causing the stopping of the shaft 13, and therefore the rectification cycle cannot begin. This commences only after the tabulation position has been reached and therefore the lowering of the slider 42 brings the end 67 of the bail 66 out of the path of the dog 11.

It is understood that modifications, additions and substitutions of parts may be made in the present invention without departing from the scope of the invention.

What we claim is:

1. Horizontal tabulation apparatus for accounting machines or the like, having a frame, a platen and a carriage having relative motion with respect to said platen for reaching predetermined tabulation positions, comprising;

means for moving said carriage, a plurality of sensing means movable from a first to a second of two positions for defining code combinations corresponding to the predetermined tabulation positions, a first shaft fixed to said frame, a plurality of cams rotatable on said first shaft, said rotation being actuated by said carriage moving means, said cams being divisible into groups for cooperation with said sensing means, each group being associated with at least a portion of a corresponding code combination, stopping means actuated by said plurality of sensing means for deactivating said moving means when said groups of cams rotate to positions defined by the positions of said sensing means to generate one of said code combinations corresponding to one of said predetermined tabulation positions, a control unit for generating said code combinations; and a plurality of corresponding electromagnets responsive to said control unit generated code combinations for moving said sensing means to said first or second positions to represent said one predetermined tabulation position.

2. Apparatus as in claim 1, in which each cam of said groups comprises at least one tooth and one space, the cams of each group simultaneously presenting the respective spaces to space sensing elements of said sensing means when said carriage is moved to said one predetermined tabulation position associated with the code combination represented by said cams.

3. Apparatus as in claim 1, further comprising: a second electromagnet controllably connected to said moving means for establishing movement of said carriage in one or in the other of two directions.

4. Apparatus as in claim 3, wherein each of said groups comprises at least two pairs of adjacent cams, the cams belonging to the first of said pairs having like profiles comprising at least one space and one tooth, said cam profiles of said first pair being offset through 90° and the profiles of the cams of the second pair being alike and offset through 180°.

5. Apparatus as in claim 4 wherein each group of said cams rotates on said first shaft with respect to the following one in a transmission ratio of 1:4.

6. Apparatus as in claim 4, wherein the cams of said first pair comprise two of said spaces and two of said teeth alternately offset by 90°, and the cams of said second pair comprise one of said spaces and one of said teeth each extending over an arc of 180°.

7. Apparatus as in claim 6 wherein each of said sensing means is associated with one of said pairs of said cams and cooperates with a first cam of said pair when said sensing means is in said first position and cooperates with a second cam of said pair when said sensing means is in said second position, to thereby establish the correspondence of the rotational position of the cams with said predetermined tabulation position, said sensing means comprising a sensing element for detecting the presence of said respective spaces and causing said sensing means to actuate said stop means when said carriage is in correspondence with said predetermined tabulation position.

8. Apparatus as in claim 7, wherein said stopping means comprises a second shaft actuated by said moving means during said carriage motion, a sleeve rotatable with said second shaft, a pair of pins parallel to said second shaft and carried by said sleeve, said pins being axially movable by said sensing means detection of said cam spaces for actuating said stop means to deactivate said moving means.

9. Apparatus as in claim 8, further comprising a third electromagnet, a rectifying mechanism actuated by said third electromagnet for effecting a further movement in one or the other of two directions in the motion of said carriage from said predetermined tabulation positions, an element rotatable with said second shaft and selectively operable by said third electromagnet, and two rocking levers alternatively cooperating with said element to cause said rotational movement of said groups of cams in order to effect said further carriage movement.

10. Apparatus as in claim 9, wherein said electromagnets corresponding to said sensing means, said second electromagnet, and said third electromagnet are actuated simultaneously by said control unit for simultaneously defining said tabulation positions.

* * * * *